United States Patent [19]

Kohyama

[11] Patent Number: 4,688,923

[45] Date of Patent: Aug. 25, 1987

[54] DEVELOPING APPARATUS

[75] Inventor: Mitsuaki Kohyama, Tokyo, Japan

[73] Assignee: Kabushiki Kaisha Toshiba, Kawasaki, Japan

[21] Appl. No.: 829,152

[22] Filed: Feb. 14, 1986

[30] Foreign Application Priority Data

Feb. 20, 1985 [JP] Japan ..... 60-30513

[51] Int. Cl.[4] ..... G03G 15/08

[52] U.S. Cl. ..... 355/3 DD; 118/657; 355/14 D

[58] Field of Search ..... 355/3 R, 3 DD, 14 D; 118/657, 658

[56] References Cited

U.S. PATENT DOCUMENTS

| | | | |
|---|---|---|---|
| 3,232,190 | 2/1966 | Willmott et al. . | |
| 3,893,418 | 7/1975 | Liebman et al. | 118/637 |
| 3,924,943 | 12/1975 | Fletcher | 355/3 R |
| 4,124,483 | 11/1978 | Christenson | 204/299 R |
| 4,378,158 | 3/1983 | Kanbe | 355/3 DD |
| 4,391,891 | 7/1983 | Tamura et al. | 118/657 X |
| 4,395,476 | 7/1983 | Kanbe et al. | 430/102 |
| 4,473,627 | 9/1984 | Kanbe et al. | 430/102 |
| 4,482,243 | 11/1984 | Suzuki et al. | 355/14 D |
| 4,508,052 | 4/1985 | Kohyama | 118/651 |
| 4,600,295 | 7/1986 | Suzuki | 355/14 D |
| 4,610,531 | 9/1986 | Hayashi et al. | 355/14 D |

FOREIGN PATENT DOCUMENTS

| | | |
|---|---|---|
| 0164262 | 12/1985 | European Pat. Off. . |
| 3100965 | 11/1981 | Fed. Rep. of Germany . |
| 1533311 | 11/1978 | United Kingdom . |

*Primary Examiner*—Fred L. Braun

*Attorney, Agent, or Firm*—Schwartz, Jeffery, Schwaab, Mack, Blumenthal & Evans

[57] ABSTRACT

A developing apparatus including an electrostatic latent image holder, a developer carrier for carrying a developer and provided opposite to the electrostatic latent image holder and separated therefrom by a predetermined gap, a developing bias voltage applying section for repeatedly applying to the gap between the electrostatic latent image holder and the developer carrier an alternating current voltage having a plurality of different frequencies in order to form an electric field in the gap sufficient for selectively causing the developer to fly and attach to the electrostatic latent image holder, and a control section for variably controlling application periods of the alternating current voltage having the plurality of frequencies by the developing bias voltage applying section while maintaining a predetermined relationship therebetween.

3 Claims, 6 Drawing Figures

DEVELOPING APPARATUS

BACKGROUND OF THE INVENTION

The present invention relates to developing apparatuses for use in an electrophotographic copying machine or the like, and more specifically, to an improved developing apparatus in which a toner surface is provided spaced opposite an electrostatic latent image surface to define a very small gap therebetween, and an A.C. bias voltage is applied across the gap to let toner fly and attach to the latent image portion.

For an electrophotographic copying apparatus widely applied to electronic copying machines, facsimile equipment, printers and the like, there has been so far employed mainly a developing method such as a cascade method or a magnetic brush method. Recently, there has been an increasing demand for putting color recording to practical use. In order to meet such demand, studies have been made to develop an image on photosensitive material allowing the superimposed development of an unfixed image on a non-contact basis. This developing method is generally called a non-contact developing method, and its basic principle is described in British Pat. No. 1,458,766, and U.S. Pat. Nos. 3,866,574 and 3,893,418. According to the inventions shown in these Patents, a cylindrical roll whose surface carriers a uniform thin layer of toner is provided close to an electrostatic latent image surface on photosensitive material (the gap therebetween is between about 5 and 500 μm) and a biased A.C. voltage is applied to the gap thereby causing the toner to vibratingly fly so as to selectively attach the toner to the electrostatic latent image portion having a potential higher than a predetermined level. U.S. Pat. No. 3,893,418 discloses a developing method wherein graduation reproducibility is selected through frequency switching on the basis of the fact that the property of a developed image varies depending on the frequency of an applied A.C. voltage.

As a result of investigations into such non-contact developing methods, it has been found that, in addition to the conventional analysis that the toner flying characteristic depends largely on such external factors as the magnitude and frequency of the applied A.C. voltage, the properties and conditions of toner itself are greatly affected by these external factors and thus it is substantially meaningless to determine the developing conditions only with reference to these external factors.

That is, it has been found that in non-contact developing systems the requirements of the A.C. voltage to be applied vary depending on the amount of electricity charged in the toner and on the particle diameter (weight) of the toner, and that the optimum frequency and voltage for the highest toner flying sensitivity also vary from toner to toner. Consequently, to compensate for variations in toner it is necessary to have some means capable of adjusting the A.C. voltage with reference to variations in the charged amount and the diameter of the toner particles in actual application. In order words, the conventional non-contact developing system which does not make such adjustments requires toner having only small variations in charged amount and particle diameter. Such toner is difficult and expensive to produce. According to the current toner production techniques, it is actually inevitable that such properties of toner vary to some extent. For this reason, toner's flying efficiency and developed result are not currently satisfactory.

Further, the conventional developing method of applying a voltage of constant frequency is defective in that, though the method can provide a high resolving power because only a narrow range of specific toner particles can fly, it has a poor image denseness and gradation reproducibility compared with the conventional magnetic brush developing method.

In order to solve the above problems, the present inventor has proposed a developing apparatus in U.S. Patent Application Ser. No. 739,878; filed May 31, 1985. In this apparatus, an A.C. voltage having a plurality of frequencies is applied during developing to compensate for variations in the distribution of toner characteristics over a comparatively wide range.

SUMMARY OF THE INVENTION

The present invention relates to a further improvement over apparatuses having the above-mentioned drawbacks and has as its object to provide a developing apparatus wherein a proportion of application periods of a developing A.C. bias voltage having a plurality of frequencies can be changed within the developing period and the frequencies can be changed in order to compensate for variations in developer characteristics over a wide range.

In order to achieve the above-mentioned object, an apparatus according to the present invention has a control means capable of changing the proportion of application periods of a developing A.C. bias voltage having a plurality of frequencies within the developing period, and thus capable of changing the values of the different frequencies.

According to the present invention, there is provided a developing apparatus comprising:

an electrostatic latent image holder;

a developer carrier for carrying a developer and provided opposite to the electrostatic latent image holder and separated therefrom by a predetermined gap;

developing bias voltage applying means for repeatedly applying to the gap between the electrostatic latent image holder and the developer carrier an alternating current voltage having a plurality of different frequencies in order to form an electric field in the gap sufficient for selectively causing the developer to fly and attach to the electrostatic latent image holder; and control means for variably controlling application periods of the alternating current voltage having the plurality of frequencies by the developing bias voltage applying means while maintaining a predetermined relationship therebetween.

BRIEF DESCRIPTION OF THE DRAWINGS

These and other objects and features of the present invention can be understood by reference to the accompanying drawings, in which.

DETAILED DESCRIPTION OF THE PREFERRED EMBODIMENT

An embodiment of the present invention will be described with reference to the accompanying drawings.

Figure 1:
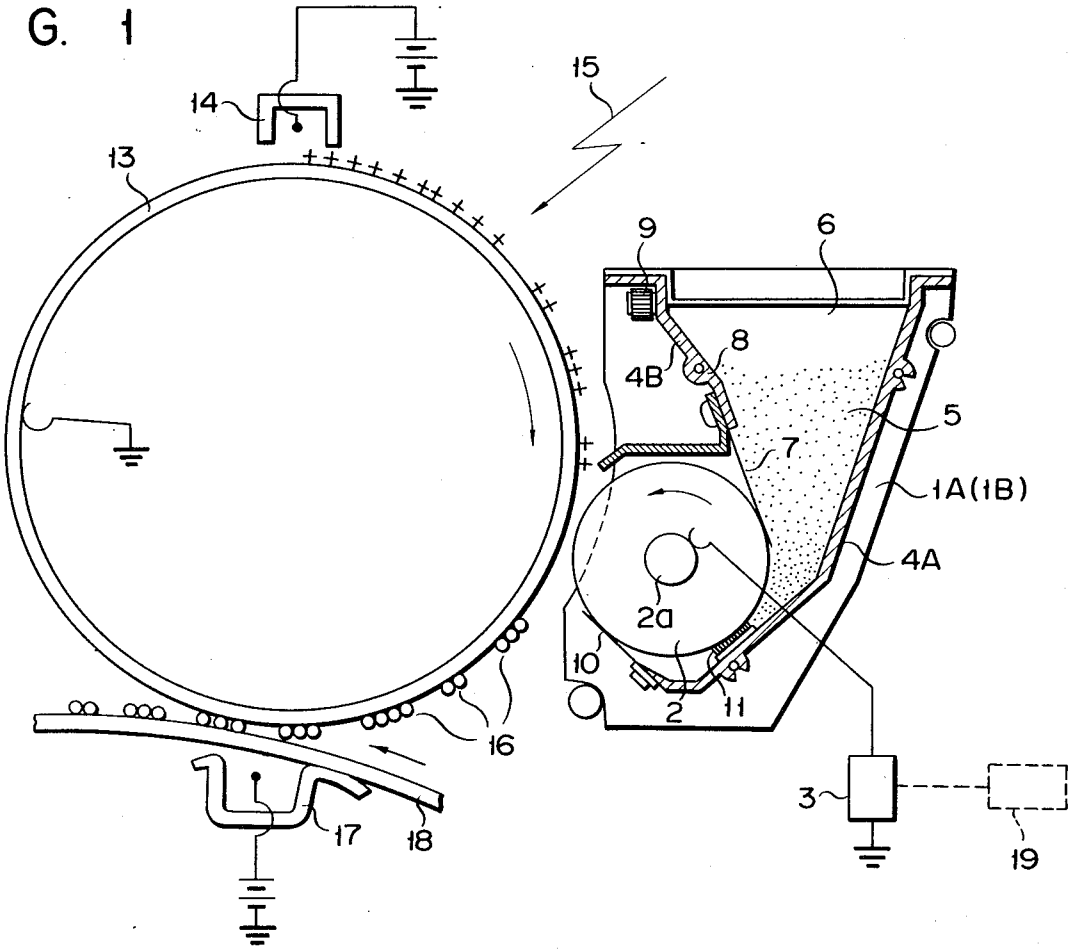
FIG. 1 is partially sectional side view of a developing apparatus according to an embodiment of the present invention.
Figure 2:
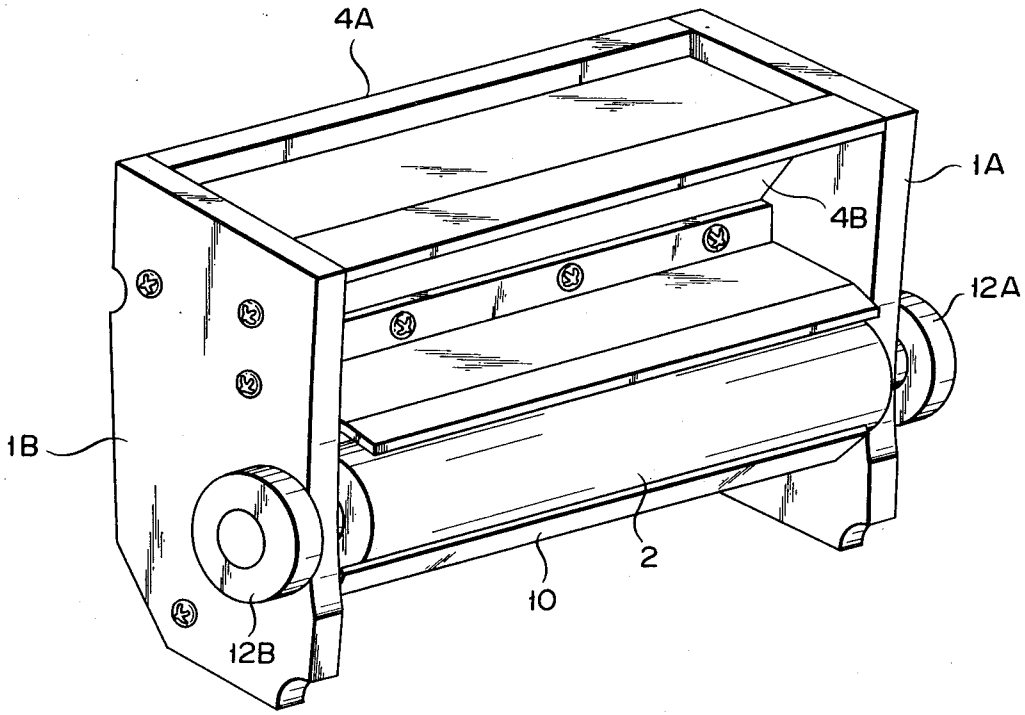
FIG. 2 is a perspective view of the same.

FIGS. 1 and 2 show a developing apparatus according to an embodiment of the present invention which is used in an electronic copying machine for developing an electrostatic latent image. In FIGS. 1 and 2, reference numerals 1A and 1B denote side frames; and 2, a developing roller serving as a developer carrier. Roller 2 is pivotally journalled by support shaft 2*b* between frames 1A and 1B and is made of a conductor, a semiconductor (having a resistivity of $10^{12}$ Ω·cm or less), or a conductor and an insulator. Reference numeral 3 denotes a bias power supply for applying a voltage to roller 2 and will be described later in detail. Reference numerals 4A and 4B denote side plates for defining hopper 6 for containing toner 5 as a developer. Reference numeral 7 denotes a coating blade supported by side plate 4B and pressed at a proper pressure against roller 2 along the longitudinal direction thereof by pressure adjusting screw 9 through pivoting plate 8. Coating blade 7 thus applies toner 5 to the surface of roller 2. Note that blade 7 is made of, e.g., an elastic metal plate having a thickness of about 0.05 to 0.2 mm. Reference numeral 10 denotes an elastic recovery blade for preventing leakage of toner 5 and for recovering the same. Blade 10 is made of, e.g., a metal or resin film. Reference numeral 11 denotes a bristle brush provided on a lower portion of side plate 4A and in slidable contact with substantially the entire length of roller 2. Brush 11 is made by planting synthetic fibers such as nylon, rayon or polypropylene in its surface. Brush 11 prevents the intrusion of foreign material into hopper 6 and temporarily removes toner 5 from roller 2. Reference numerals 12A and 12B denote guide rollers provided concentrically with support shaft 2*a* of roller 2. Guide rollers 12A and 12B are provided close to the surface of photosensitive drum 13 and maintain the gap between the surfaces of roller 2 and drum 13 at about 100 to 500 μm. Note that drum 13 is obtained by forming an electrophotographic photosensitive material such as amorphous selenium or amorphous silicon into a drum shape.

Figure 3:
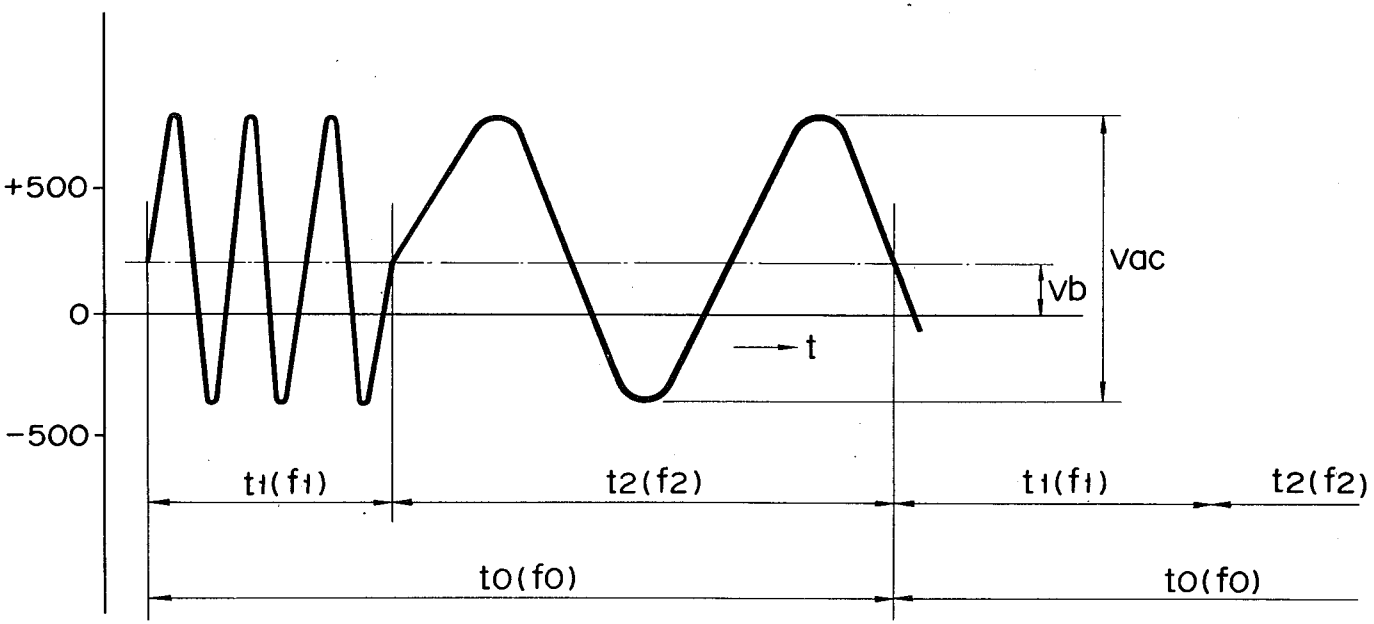
FIG. 3 is a waveform chart of an example of an A.C. voltage having a plurality of frequencies.

The developing process of the developing apparatus of the present invention having the above-mentioned structure will now be described. Drum 13 is arranged in, e.g., a known electrophotographic copying machine (not shown) and rotated at a speed of about 130 mm/second along a direction indicated by the arrow while being charged to about 600 to 700 V by charger 14. Desired optical image 15 from an optical system (not shown) is exposed to form an electrostatic latent image. The latent image is sequentially fed to the developing apparatus of the present invention. Meanwhile, singlecomponent nonmagnetic toner 5 having an average particle diameter of 8 to 13 μm is deposited to form a uniform toner layer 20 to 30 μm thick on roller 2. Roller 2 is rotated at substantially the same speed as drum 13 along a direction indicated by the arrow. Toner 5 is charged to 2 to 15 micro-coulombs/g by friction with blade 7 or roller 2 and sequentially fed to the gap of 100 to 500 μm opposing drum 13. During this period, A.C. voltage Vac is applied to the gap by bias power supply 3 as an external applied voltage in addition to an electric field caused by the charge of the electrostatic latent image. When the gap is set to 250 μm, voltage Vac is modulated to a plurality of frequencies f1 and f2 having a representative peak-to-peak value of 800 to 1,800 V and biased from 0 potential to its positive side by Vb V as shown in FIG. 3. Then, toner 5 repeats flying to attach to portions corresonding to the latent image, thereby forming visible image 16. Image 16 is transferred onto copy sheet 18 by next transfer charger 17 and conveyed to a fixing device (not shown) to be fixed.

The basic structure of the developing apparatus described so far is substantially the same as that described in U.S. Patent Application Ser. No. 739,878, filed May 31, 1985, and E.P.O. Appliation No. 85303910.5 mentioned before. Bias power supply 3 of the present invention, however, was developed as the result of further study on duration periods t1 and t2 of a plurality of frequencies f1 and f2 which serve as factors for deciding image quality, period t0, required for one cycle of periods t1 and t2, and its repetition frequency f0. More particularly, supply 3 of the present invention has a means capable of adjusting at least periods t1 and t2 of these image quality-deciding factors, a means capable of adjusting frequencies f1 and f2, or a means capable of adjusting periods t1 and t2 and frequencies f1 and f2. With these adjusting means, the developing apparatus of the present invention enables strict image quality control compared with a conventional apparatus. The adjusting means and its effects will be described using the results of the study mentioned above.

Figure 4:
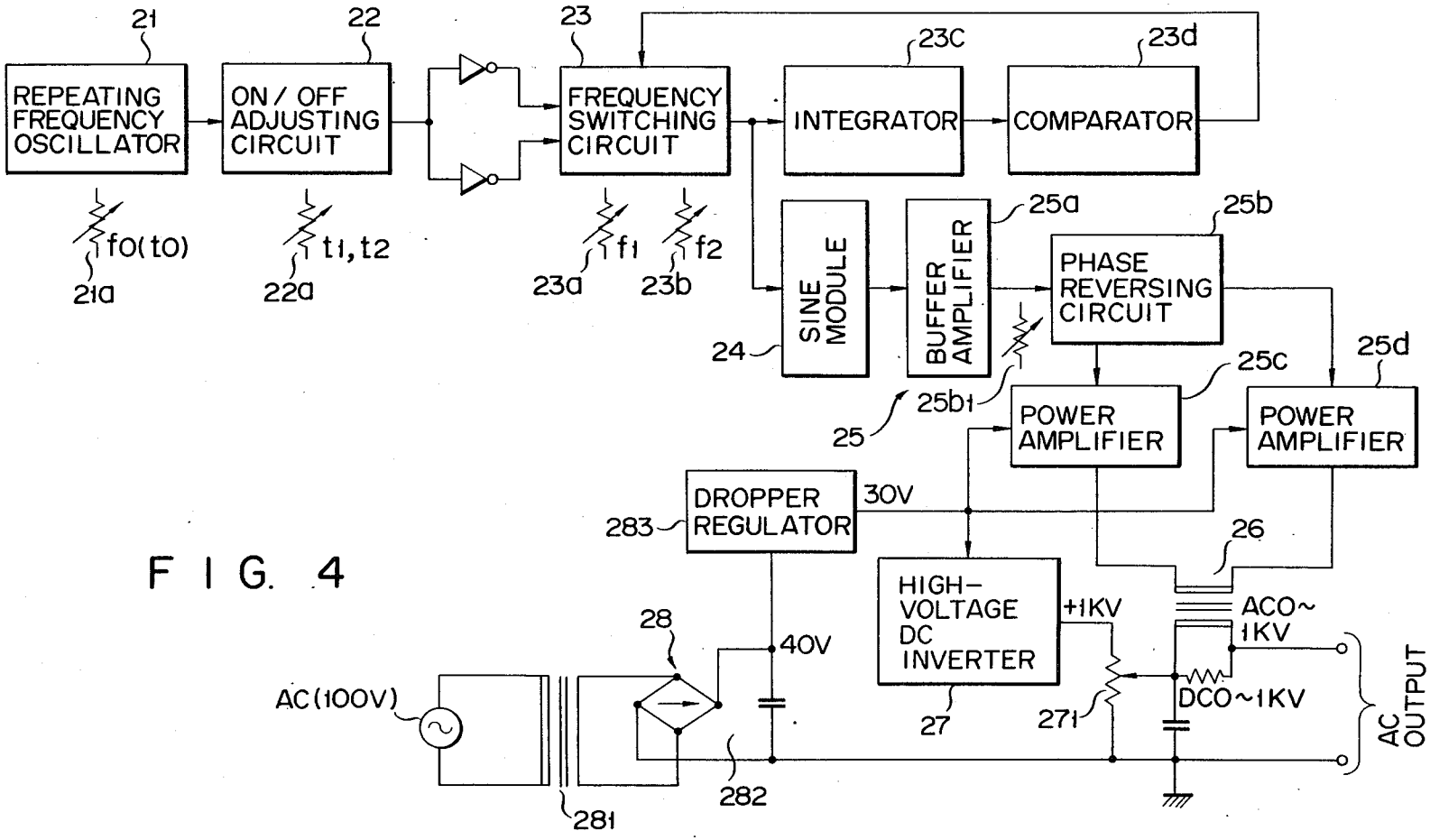
FIG. 4 is a block diagram of an example of a bias power supply used in an embodiment of the present invention.

An example of a configuration of bias power supply 3 for generating an A.C. voltage, the frequency of which can be modulated, will be described with reference to FIG. 4. Adjusting section 21*a* of repeating frequency oscillator 21 is operated to determine frequency f0 or period t0 described above. Adjusting section 22*a* of on/off adjusting circuit 22 is adjusted so that the output of oscillator 21 is switched between on- and off-outputs to maintain the relation $t1+t2=t0$. Output from circuit 22 drives frequency switching circuit 23, which has a feedback loop including integrator 23*c* and comparator 23*d*. Adjusting sections 23*a* and 23*b* of circuit 23 are operated to obtain a triangular-wave output having a frequency capable of being modulated to be switched between frequencies f1 and f2. An output from circuit 23 is shaped as a sine wave by sine module 24, and supplied to amplifier 25. Amplifier 25 consists of buffer amplifier 25*a*, phase inverting circuit 25*b* having adjusting section 25*b*1, and power amplifiers 25*c* and 25*d*. An output from amplifier 25 is supplied to output transformer 26 to obtain a constant A.C. output of 0 to 1,000 V. A D.C. output of 0 to +1,000 V obtained by high-voltage D.C. inverter 27 and its adjusting section 271 is applied to the output side of transformer 26 so that the A.C. output can be biased by a predetermined potential on its positive side. Note that reference numeral 28 denotes a power supply circuit having transformer 281, rectifier 282 and dropper regulator 283. Power supply circuit 28 is connected to an A.C. power supply A.C. (100 V) for supplying a D.C. voltage (30 V) to amplifier 25, inverter 27 and so on. With this arrangement, variable ranges of the above-mentioned elements are set such that frequencies f1 and f2 are 200 to 5,000 Hz, frequency f0 is 100 to 1,000 Hz or more, the A.C. output voltage is 0 to 1,000 V, and the D.C. output voltage is 0 to 1,000 V.

Figure 5:
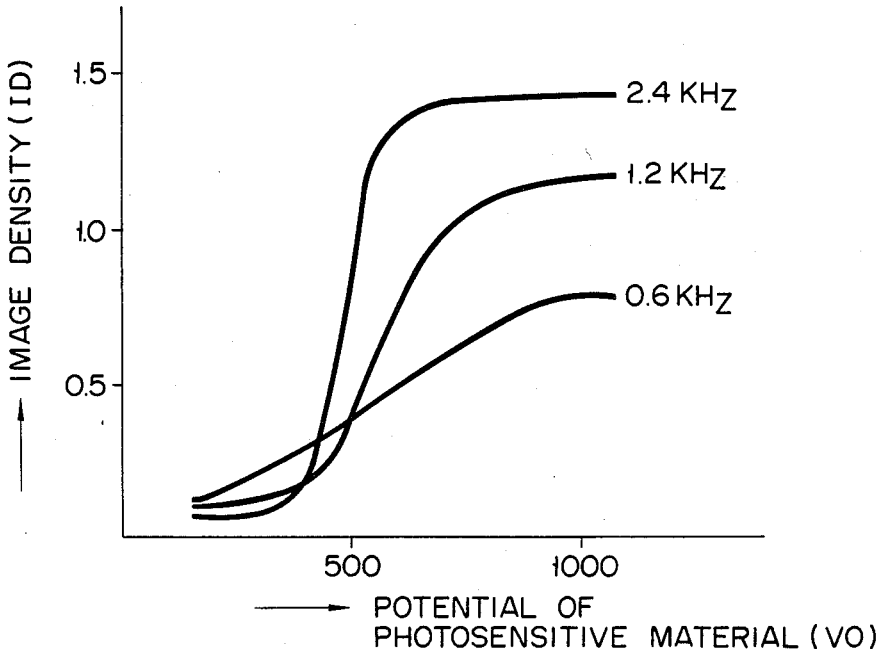
FIGS. 5 and 6 show characteristic curves giving relations between the potential of a photosensitive material and image density.
Figure 6:
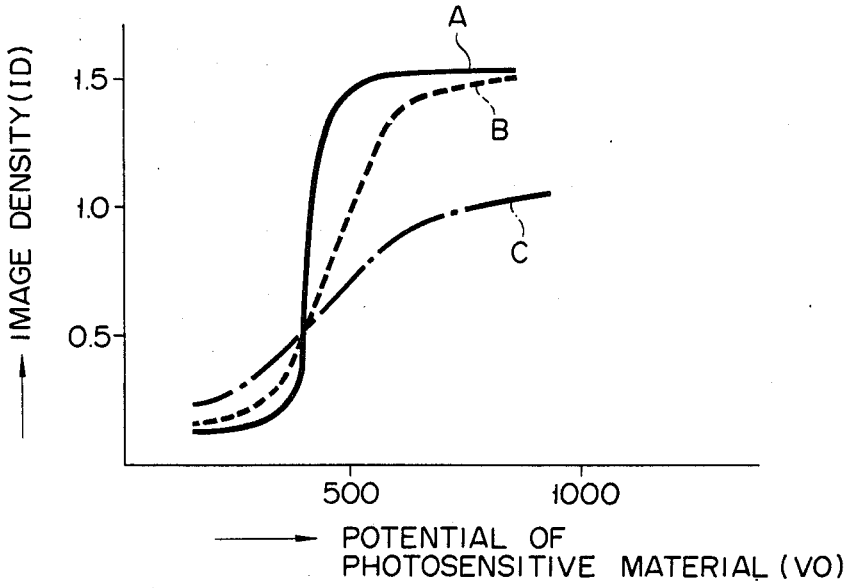

A major improvement in image quality obtained by adopting bias power supply 3 in the developing apparatus will be described hereinafter. FIG. 5 shows the relationship between potential V0 of photosensitive drum 13 and image density ID. In FIG. 5, the higher the appiled frequency, the higher the so-called $\gamma$ characteristic. This relationship is obtained when the toner charge is 7 micro-coulombs/g, the average toner particle diameter is 12 $\mu$m, the applied voltage is 1,400 V (peak-to-peak value), and the voltage is biased by 150 V to its positive side. Except for the above, the conditions are the same as mentioned earlier. This relationship between potential V0 and image density ID is conventionally known. However, according to the conventional technique, fog cannot be decreased at a low $\gamma$ characteristic, and maximum density is not satisfactory. According to the present invention, however, assume that a developing bias of 600 Hz having the $\gamma$ characteristic indicated by curve C in FIG. 6 is applied under the same conditions as above except that t1=1.25 mm/second, t2=0.125 mm/second, and f0=400 Hz, in addition to the developing bias of 2,400 Hz having the $\gamma$ characteristic indicated by curve A. Fog is reduced, maximum density is increased, and the $\gamma$ characteristic is improved to the medium level indicated by curve B between curves A and C. The $\gamma$ characteristic tends to change continuously between curves A and C depending on the ratio of t1 and t2 and can be controlled arbitrarily. In addition, other similar experiments revealed that when the two frequencies were changed as shown in FIG. 5, the variable range of the image quality can also be changed by adjusting periods t1 and t2. These effects can be understood by examining FIGS. 3, 5 and 6.

The adjusting means described above is provided for supply 3 so that variations in image quality-influencing factors such as toner characteristics and the gap between drum 13 and roller 2 are correctly compensated for by applying a frequency-modulated bias voltage. This also brings about a desired quality adjustment.

The adjustment can be performed using software by control circuit 19 (indicated by a broken line in FIG. 1) having a microcomputer. In this case, various copying modes, such as copying of a photograph, requiring a low $\gamma$ characteristic, and copying of a diagram, requiring high contrast, can be selected by automatically controlling the above-mentioned conditions such as periods t1 and t2 and frequencies f1 and f2, resulting in a wide range of applications.

According to the present invention, then, there is provided a developing apparatus wherein a proportion of application periods of a developing A.C. bias voltage having a plurality of frequencies can be changed within the developing period and the frequencies can be changed in order to compensate for variations in developer characteristics over a wide range.

What is claimed is:

1. A developing apparatus for applying a developer to an electrostatic latent image, said apparatus comprising:

an image-bearing member carrying the electrostatic latent image;

a developer carrier carrying a developer thereon, said developer carrier opposing said image-bearing member, with a clearance therebetween to define a developing zone;

means for applying an alternating electric field to said developing zone to produce movement of the developer between said image-bearing member and said developer carrier within said developing zone, said alternating electric field having a first frequency in a first application period and a second frequency, different from the first frequency, in a second application period; and means for varying the length of at least one of said first and second application periods.

2. An apparatus according to claim 1, further comprising control means comprising means for changing said first and second frequencies.

3. An apparatus according to claim 1, wherein the clearance defining said developing zone is set to be larger than a thickness of the developer carried by said developer carrier.

* * * * *